US006944891B2

(12) United States Patent
Kuru et al.

(10) Patent No.: US 6,944,891 B2
(45) Date of Patent: Sep. 20, 2005

(54) TOILETS WITH TRAPWAYS HAVING AN AIR DAM

(75) Inventors: William C. Kuru, Plymouth, WI (US); Sudip Mukerji, Cedarburg, WI (US)

(73) Assignee: Kohler Co., Kohler, WI (US)

( * ) Notice: Subject to any disclaimer, the term of this patent is extended or adjusted under 35 U.S.C. 154(b) by 138 days.

(21) Appl. No.: 10/347,740

(22) Filed: Jan. 20, 2003

(65) Prior Publication Data

US 2004/0139537 A1 Jul. 22, 2004

(51) Int. Cl.[7] ..... E03D 11/00
(52) U.S. Cl. ..... 4/420
(58) Field of Search ..... 4/428, 328, 420–427, 4/429, 430

(56) References Cited

U.S. PATENT DOCUMENTS 510,997 A * 12/1893 Smith ..... 4/428
2,129,398 A * 9/1938 Beam ..... 4/425
3,484,873 A 12/1969 Hoard et al.
4,145,772 A * 3/1979 Whitney et al. ..... 4/300
4,987,616 A 1/1991 Ament
5,404,597 A * 4/1995 Hennessy ..... 4/424
5,706,529 A 1/1998 Kai et al.
5,918,325 A 7/1999 Arita et al.
5,983,413 A 11/1999 Hayashi et al.
6,145,138 A 11/2000 Nakamura et al.
6,292,956 B1 9/2001 Kayahara

* cited by examiner

*Primary Examiner*—Charles E. Phillips
(74) *Attorney, Agent, or Firm*—Quarles & Brady LLP

(57) ABSTRACT

A toilet has a trapway extending between a bowl opening and an outlet opening. The trapway defines a curved water dam region above the bowl opening, a down leg, and a straight out leg between the down leg and the outlet opening. The out leg has an air dam cavity such that the trapway has an increased cross-sectional area at the air dam.

8 Claims, 3 Drawing Sheets

TOILETS WITH TRAPWAYS HAVING AN AIR DAM

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to plumbing fixtures, and in particular to toilets provided with improved trapways.

Conventional toilets have a bowl and a flush tank cast in one or two pieces. A serpentine passage is formed in the toilet (or the bowl component of a two-piece toilet) to transport the contents of the bowl to an outlet opening that is usually at the bottom of the bowl. That opening is coupled to the waste plumbing lines of the building.

This passage is generally referred to as the bowl "siphon" or "trapway". An upstream portion of this passage is normally filled with water, before and after a flush cycle, to "trap" sewer gases downstream thereof so as to prevent them entering the building interior. Water is maintained in the bowl and the upstream part of the trapway by forming an arched section that extends above the height of the bowl opening. The trapway (sometimes in conjunction with a jet passageway) generate a siphon to evacuate the bowl contents when the normally air/vapor-filled downstream portion of the trapway is rapidly filled with water during the flush cycle.

The trapway thus retains water in the bowl prior to flushing, and then assists in the formation of a siphon helpful in removing waste during the flush cycle. One common problem is to try to achieve this in low volume toilets. In this regard, for environmental and water conservation reasons many jurisdictions now restrict the sales of toilets which use too much water per flush. Thus, the water in the flush cycle must be used extremely efficiently.

To achieve a powerful flush, trapways are sometimes designed to maximize the flow rate and available volume of the trapway that can occupied during flushing. Various ways to accomplish this include specially shaping the flow path, controlling the state of flow (turbulent or laminar), and/or reducing or eliminating the occurrence of air pockets particular locations in the trapway. For example, U.S. Pat. No. 5,918,325 discloses a trapway modified in various ways to attempt to render flushing more optimal.

See also U.S. Pat. Nos. 3,484,873, 5,706,529 and 6,292,956. The disclosures of these patents, and of all other patents and publications referred to herein are incorporated by reference as if fully set forth herein.

However, prior art designs often did not adequately reduce or eliminate "blow back", which is a reverse flow of air from the plumbing lines into a low pressure region of the trapway. To some extent, this obstructed flow through the trapway and caused a slower flush.

Accordingly, improved trapway designs were still needed, particularly in connection with low volume flush toilets.

SUMMARY OF THE INVENTION

In accordance with one aspect, the invention provides a toilet having a trapway. The trapway extends between a bowl opening and an outlet. The trapway has a curved water dam region extending from the bowl opening to above the bowl opening to a down leg, the down leg being linked to a out leg at a lower end of the down leg, the out leg communicating with the outlet.

A key attribute of the invention is that the trapway has an air dam cavity along an upper wall of the out leg causing flow passing trough the trapway to separate from an interior surface of the trapway at a leading edge of the air dam. This structure is preferably used where there is also an essentially horizontal baffle extending forward from a rear wall of the down leg adjacent a lower portion of the down leg.

In other preferred forms, the trapway has a circular cross-section throughout the curved water dam region which does not vary more than 5 percent in diameter throughout the portion of the trapway that is the curved dam, the down leg slopes somewhat from its top to the baffle in a rearward direction, albeit sloping less than 15 degrees from vertical, and the out leg is essentially horizontal.

In another preferred form at least a portion of the out leg is straight, and at least a portion of the down leg is straight.

The present invention thus provides a toilet with a unique trapway design that has several advantages over the prior art. The trapway is designed so that water from the bowl completely and quickly fills key portions of the trapway during a flush cycle. This leads to rapid evacuation of the bowl contents, minimizing water waste.

The rearwardly slightly canted down leg reduces or eliminates the formation of air pockets in the water dam region which would otherwise interfere with the siphoning effect of the trapway. The uniform circular cross-section of the curved water dam region helps to lift the surface of the fluid at the water dam during siphon initiation, which further helps to remove air.

Most importantly, the air dam aids in rapid flushing by separating the fluid from the inside wall of the down leg thereby creating a sheet of fluid that blocks air blow back from flowing into the low-pressure region downstream from the air dam.

These and still other advantages of the invention will be apparent from the detailed description and drawings. What follows is merely a description of a preferred embodiment of the present invention. To assess the full scope of the invention the claims should be looked to as the preferred embodiment is not intended to be the only embodiment within the scope of the claims.

DETAILED DESCRIPTION OF THE PREFERRED EMBODIMENT

Figure 1:
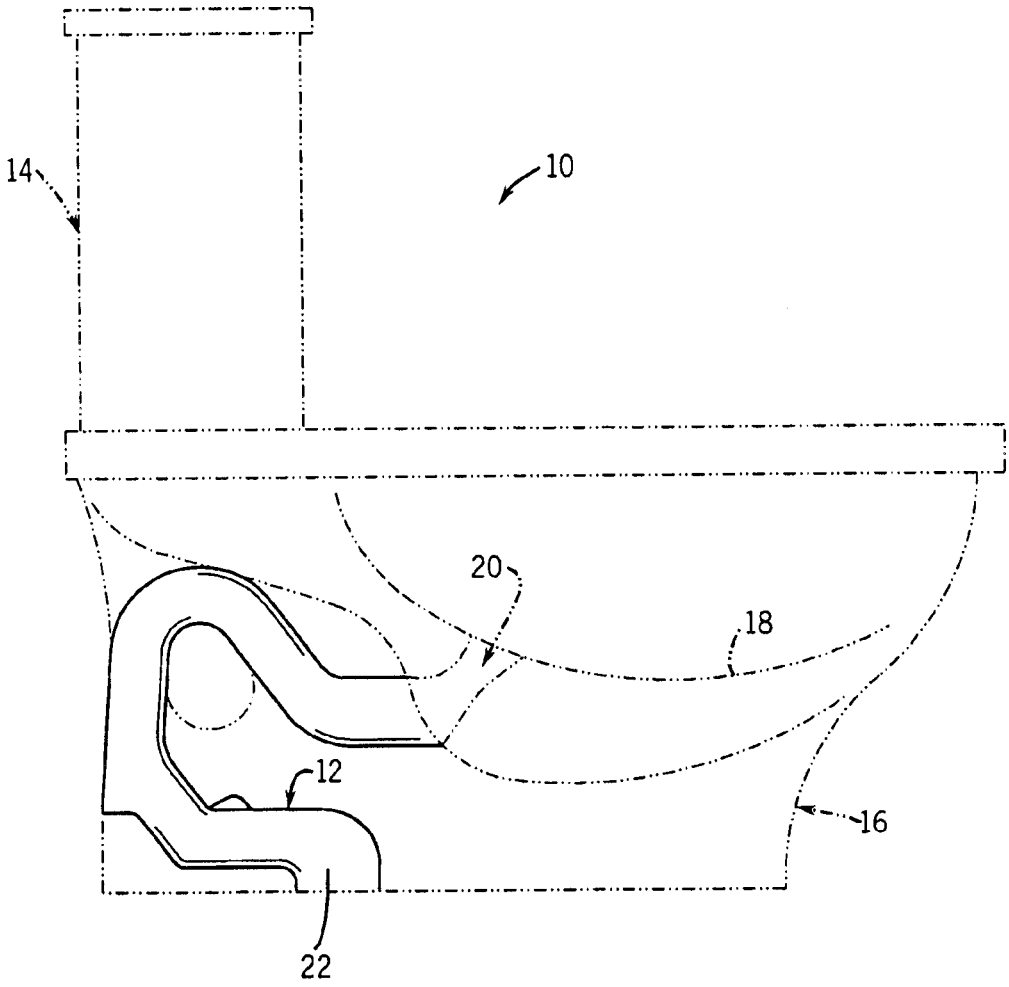
FIG. 1 is a side plan view of a toilet trapway according to the present invention, with a typical environment that the trapway can used in being shown in dotted lines.

FIG. 1 illustrates a toilet 10 having a siphon passage or trapway 12 design according to the present invention. In particular, other than the trapway 12, the toilet 10 can be any suitable one or two piece toilet, preferably of a low volume flush design, as known in the art.

For example, FIG. 1 shows in hidden lines a two-piece toilet having a separate flush tank 14 mounted to a bowl base 16. A hole (not shown) in the bottom of the flush tank 14 aligns with a hole (not shown) in the top of the bowl base 16 to allow water to pass from the flush tank and into the a bowl 18, formed in the bowl base 16, during a flush cycle.

Figure 3:
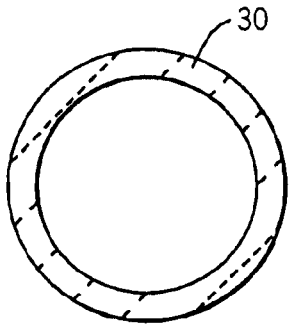
FIG. 3 is a cross-sectional view taken along line 3—3 of FIG. 2.

The trapway 12 extends from an opening 20 in the bowl 18 along a serpentine path, having an essentially uniform and constant circular cross-section (as shown in FIG. 3) at least in the second bend 30 at the water dam 34. The trapway has an outlet opening 22 at the bottom of the bowl base 16, which mounts over the open end of a waste plumbing line (not shown). The trapway 12 thus creates a path for contents in the bowl 18 to flow to the waste line during a flush cycle.

Figure 2:
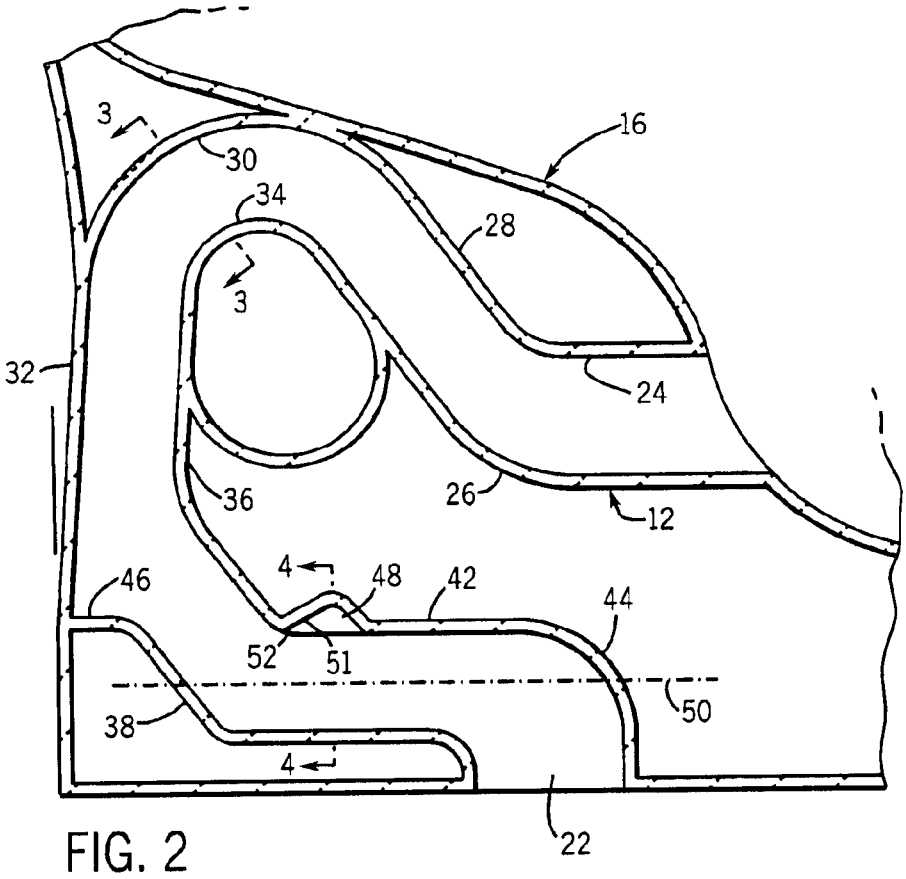
FIG. 2 is a vertical cross-sectional view taken down the center line of the rear of the toilet of FIG. 1.

Referring to FIG. 2, a straight entry 24 of the trapway 12 extends back from the bowl opening 20 to a first upward bend 26. An essentially straight backwardly up leg 28 extends upwardly from the first bend 26 at about a 40–60 degree angle to a second bend 30. A down leg 32 extends from the second bend 30 declining slightly backwardly from top to bottom away from the opening 20 at, preferably, an angle approximately between 1–10 degrees from vertical, most preferably a 4–6 degree angle.

The bend 30 forms about a 40 degree angle between the up leg 28 and the down leg 32 so as to change flow direction about 140 degrees from the direction of flow through the up leg 28. The surface at the inside diameter of the second bend 30 forms a water dam 34 (along the lower inside surface) after which point water can pass from the bowl 18 to the waste line through the downstream portion of the trapway 12. The bottom end of the down leg 32 transitions at another bend 36 which leads to a short, straight forwardly declining leg 38. Leg 38 terminates at a bend 40 leading to a straight, horizontal out leg 42 ending at a 90 degree bend 44 leading to the outlet opening 22.

Figure 6:
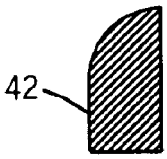
FIG. 6 is a cross-sectional view showing one half of the area of the trapway passage through line 6—6 of FIG. 5.
Figure 9:
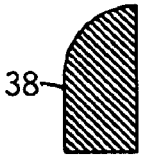
FIG. 9 is a cross-sectional view similar to FIG. 6 albeit taken at line 9—9 of FIG. 5.

The trapway 12 has a generally uniform circular cross-section between the bowl opening and throughout the curved second bend 30 at the water dam 34 and through the down leg 32. Preferably, the inside cross-section does not vary more than 5 percent in diameter throughout this portion of the trapway 12. FIGS. 6 and 9 illustrate the non-circular cross-sections of the short angled leg 38 and the out leg 42, which have flat lower surfaces, primarily for casting considerations.

Adjacent the bottom end of down leg 32, the trapway 12 has a short, flat horizontal baffle 46 extending between the rear wall of the down leg 32 and the short angled leg 38. The baffle 46 preferably extends a length about equal to the radius of the down leg 32, or in one case about 1 1/16". The baffle 46 works to generate turbulence and change the trajectory of the flow leaving the down leg 32, which helps move the flow downstream.

Figure 4:
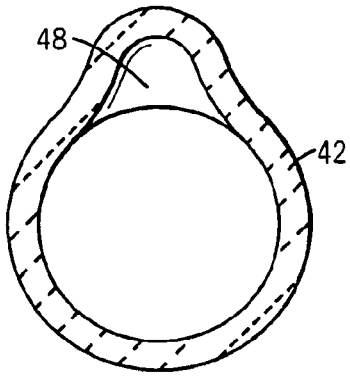
FIG. 4 is a cross-sectional view taken along line 4—4 of FIG. 2.
Figure 5:
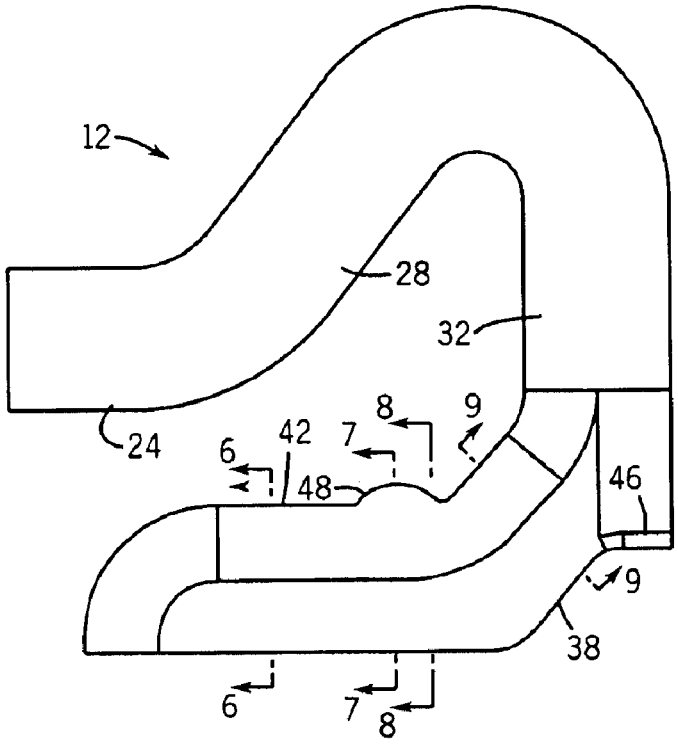
FIG. 5 is a reverse side view showing half of the trapway diagrammatically.

In accordance with the present invention, a recessed cavity or pocket 48, referred to herein as an air dam 48, is formed to extend about an upper interior portion of the out leg 42 on a side of a centerline 50 opposite the outlet opening 22. Preferably, the air dam 48 is adjacent to the intersection of the angled leg 38 and the out leg 42. The air dam 48 extends upwardly from an upper interior surface of the out leg 42 preferably in a smooth, contoured pyramidal-type configuration such that its base is larger than its tip, as shown in FIG. 4. Note, however, that the air dam 48 could be any suitable shape, such as hemi-spherical, as long as a sharp or small radius edge is formed at the leading edge of the air dam 48 sufficient to cause separation of the flow from the trapway 12. Preferably, the upstream upwardly extending surface 51 of the air dam 48 forms about a 90 degree angle or less to aid in separation of the fluid from the surface of the trapway 12 as described below.

Figure 7:
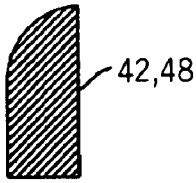
FIG. 7 is a cross-sectional view similar to FIG. 6 albeit taken at line 7—7 of FIG. 5.
Figure 8:
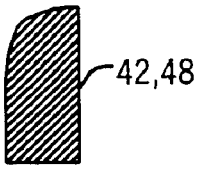
FIG. 8 is a cross-sectional view similar to FIG. 6 albeit taken at line 8—8 of FIG. 5.

FIGS. 7 and 8 show half cross-sections of the through the out leg 42 at the air dam 48. The air dam 48 is about ½" to 1" (preferably ⅝") high, about ½" to 3" in length (preferably 1½") and about the diameter of the out leg 42 (preferably 2⅛").

The trapway 12 described above is designed so that water from the bowl completely and quickly fills key portions of the trapway 12 during a flush cycle. This is achieved because the backwardly canted down leg 32 reduces or eliminates the formation of air pockets at the water dam 34 which interfere with the siphoning effect of the trapway 12, the uniform circular cross-section of the second bend 30 helps to lift the surface of the fluid at the water dam 34 during siphon initiation.

Figure 10:
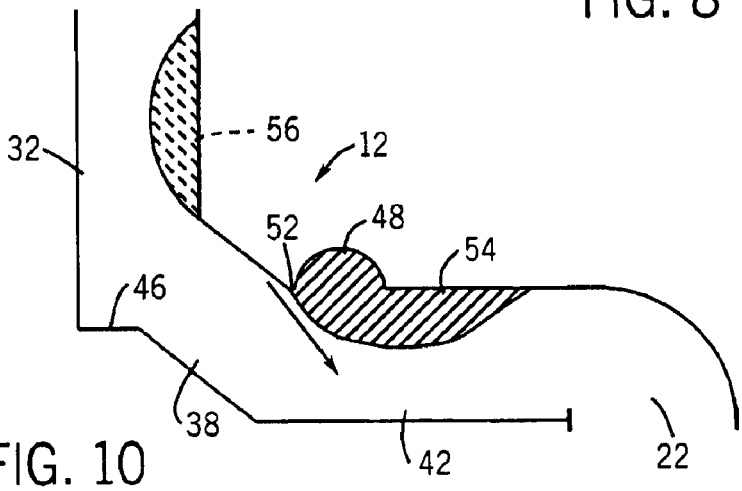
FIG. 10 is a diagrammatic representation of the trapway showing an air pocket (in full cross-hatch) generated by an air dam in the out leg of the trapway and also an air pocket (in phantom) formed by waste line blow back to a low pressure area in a down leg of the trapway not present in the trapway disclosed herein but which did occur in some prior trapway designs.

Furthermore, the air dam 48 aids in rapid flushing by separating the fluid from the inside wall of the down leg 32 causing a sheet of fluid within the trapway 12 that tends to block air that may try to pass back through the trapway 12 from the waste line to a low-pressure region in the down leg 42 downstream from the water dam 34. More specifically, as shown in FIG. 10, during flushing fluid passes beyond the water dam 34 into the down leg 32 and the other normally air-filled downstream portions of the trapway. Fluid leaves the lower end of the down leg and into the short angled leg 38. After leaving the lower end of the short angled leg 38, fluid at the upper surface (when viewed as shown in FIG. 2) of the trapway passes by a leading edge surface 52 of the air dam 48 (preferably being a small radius convex surface or a short flat sharp angle surface) which leads to the upwardly extending surface 51 of the air dam 48 preferably forming a right or acute angle with the short angled leg 38. This causes the fluid to separate from the upper surface of the trapway at a relatively high velocity. This in turn causes an air pocket 54 to form generally in the region of the out leg 42 shown by the solid cross-hatching. This effectively reduces the cross-sectional area through the out leg 42, which increases the pressure and velocity of the fluid through the out leg 42. This does two things. It increases the rate that the fluid passes through the out leg 42 (despite the smaller cross-sectional area) and causes the fluid to generate a greater down-ward force to counter the force of air in the waste line tending to move to a low pressure region in the down leg 32 and forming an air pocket 56 in the down leg 32 as represented by the hidden line cross-hatching, which is may occur sporadically depending on the which pressure prevails. This phenomenon, referred to as "blow back", is adverse to providing a rapid, powerful flush. Thus, the air dam 48 prevents blow back, and thus allows the fluid to pass through the full area of the down leg 32 and short angled leg 38, and speeds the rate of flow through the out leg 42.

Thus, overall, the trapway 12 provides a better, more consistently rapid flushing.

It should be appreciated that a preferred embodiment of the invention has been described above. However, many modifications and variations to the preferred embodiment will be apparent to those skilled in the art, which will be within the spirit and scope of the invention. Therefore, the invention should not be limited to the described embodiment. To ascertain the full scope of the invention, the following claims should be referenced.

INDUSTRIAL APPLICABILITY

The invention provides improved toilets that more efficiently flush waste material.

What is claimed is:

1. In a toilet of the type having a trapway, the trapway extending between a bowl opening and an outlet, the trapway having a curved water dam region extending from the bowl opening to above the bowl opening to a down leg, the down leg being linked to an out leg at a lower end of the down leg, the out leg communicating with the outlet, the improvement comprising:

the trapway having an air dam cavity along an upper wall of the out leg causing flow passing through the trapway to separate from an interior surface of the trapway at a leading edge of the air dam;

wherein the trapway further comprises an essentially horizontal baffle extending forward from a rear wall of the down leg adjacent a lower portion of the down leg; and wherein the trapway has a circular cross-section throughout the curved water dam region which does not vary more than 5 percent in diameter throughout the portion of the trapway that is the curved water dam.

2. In a toilet of the type having a trapway, the trapway extending between a bowl opening and an outlet, the trapway having a curved water dam region extending from the bowl opening to above the bowl opening to a down leg, the down leg being linked to an out leg at a lower end of the down leg, the out leg communicating with the outlet, the improvement comprising:

the trapway having an air dam cavity along an upper wall of the out leg causing flow passing through the trapway to separate from an interior surface of the trapway at a leading edge of the air dam;

wherein the down leg slopes somewhat from its top to the baffle in a rearward direction, albeit sloping less than 15 degrees from vertical.

3. The toilet of claim 2, wherein the trapway further comprises an essentially horizontal baffle extending forward from a rear wall of the down leg adjacent a lower portion of the down leg.

4. The toilet of claim 2, wherein no air pocket is formed in the down leg.

5. The toilet of claim 2, wherein the out leg is essentially horizontal.

6. The toilet of claim 2, wherein at least a portion of the out leg is straight.

7. The toilet of claim 2, wherein at least a portion of the down leg is straight.

8. The toilet of claim 2, wherein an air pocket is formed in the out leg.

* * * * *